US007454030B2

(12) United States Patent
Graber

(10) Patent No.: US 7,454,030 B2
(45) Date of Patent: Nov. 18, 2008

(54) SUBWOOFER WITH CASCADED LINEAR ARRAY OF DRIVERS

(76) Inventor: Curtis H. Graber, 9301 Roberts Rd., Woodburn, IN (US) 46797

( * ) Notice: Subject to any disclaimer, the term of this patent is extended or adjusted under 35 U.S.C. 154(b) by 722 days.

(21) Appl. No.: 10/649,040

(22) Filed: Aug. 27, 2003

(65) Prior Publication Data

US 2005/0047622 A1 Mar. 3, 2005

(51) Int. Cl.
*H04R 1/02* (2006.01)
*H04R 1/20* (2006.01)

(52) U.S. Cl. ..... 381/341; 381/342; 381/97; 381/186; 181/152; 181/145; 181/177

(58) Field of Classification Search ..... 381/340, 381/341, 342, 343, 97, 186; 181/177, 187, 181/188, 152, 145
See application file for complete search history.

(56) References Cited

U.S. PATENT DOCUMENTS

| | | | | |
|---|---|---|---|---|
| 2,801,703 | A | | 8/1957 | Martin |
| 3,432,002 | A | | 3/1969 | Cohen |
| 4,138,594 | A | | 2/1979 | Klipsch |
| 4,206,831 | A | | 6/1980 | Welch et al. |
| 4,227,051 | A | * | 10/1980 | Thomas et al. ..... 381/342 |
| 4,313,032 | A | | 1/1982 | Thomas et al. |
| 4,344,504 | A | * | 8/1982 | Howze ..... 181/187 |
| 4,348,549 | A | | 9/1982 | Berlant |
| 4,845,759 | A | * | 7/1989 | Danley ..... 381/97 |
| 5,296,656 | A | | 3/1994 | Jung |
| 5,397,866 | A | * | 3/1995 | Lyons et al. ..... 181/152 |
| 5,526,456 | A | * | 6/1996 | Heinz ..... 381/340 |
| 5,898,138 | A | | 4/1999 | Delgado, Jr. |
| 5,925,856 | A | | 7/1999 | Meyer et al. |
| 5,940,347 | A | | 8/1999 | Raida et al. |
| 6,118,883 | A | * | 9/2000 | Rocha ..... 381/387 |
| 6,411,718 | B1 | * | 6/2002 | Danley et al. ..... 381/342 |
| 2001/0016045 | A1 | * | 8/2001 | Ohta ..... 381/98 |

* cited by examiner

*Primary Examiner*—Vivian Chin
*Assistant Examiner*—Jason Kurr
(74) *Attorney, Agent, or Firm*—O'Malley and Firestone

(57) ABSTRACT

A single folded, expanding horn loudspeaker reproduces low frequency audible sound at high power output levels. A compact enclosure houses a plurality of identical transducers, characterized by small vibrational surface areas. The throats for each transducer into the horn are acoustically differentially spaced from the mouth of the horn. Transducer drive circuitry adjusts a drive signal for the transducers to compensate for the different impedance and propagation time to the horn mouth at each throat.

12 Claims, 9 Drawing Sheets

26
28
30
32
701
703
705
707
709
DSP
713
715
717
719
711
AUDIO FREQ. SOURCE

SUBWOOFER WITH CASCADED LINEAR ARRAY OF DRIVERS

BACKGROUND OF THE INVENTION

1. Technical Field

The invention relates to an electro-acoustical device and, more particularly, to a folded horn loudspeaker for reproducing low frequency audible sound at high output levels from electric-acoustic transducers having relatively small diaphragms.

2. Description of the Problem

The reproduction of low frequency audible sound, with high fidelity and at high intensity levels, poses a number of challenges. To do so from a small, energy efficient package, portable enough to be moved and suitable for open air use is especially difficult. Generally, high output, high efficiency, low frequency loudspeakers have been built around a horn. A horn is in effect an acoustic transformer, allowing the designer to obtain the output performance of a driving unit having a large area diaphragm from a unit having a smaller area diaphragm while minimizing cone/diaphragm resonance issues that exist with direct radiator devices. Increasing the effective diaphragm area renders radiation impedance increasingly resistive with the result that increasing power is radiated at the desired low frequencies. However, increasing acoustic power output from most horn designs has required increasing diaphragm piston travel in order to move the required volume velocity of air. Piston travel becomes an important limiting factor relating to the amount of power that can be delivered to the horn.

Another limitation on the total energy input that can be introduced to a horn has been the limited scalability of horns. Though examples of multiple driver horns are known, typically only a single driving unit for a given frequency range has been provided. One example of a multiple driver horn (U.S. Pat. No. 5,898,138) positions a pair of low frequency transducers having throats located equidistant from the horn's mouth. While effective such an arrangement is still not readily scalable.

SUMMARY OF THE INVENTION

According to the invention there is provided a folded, expanding horn loudspeaker having a selectable plurality of acoustic drivers for a given frequency range. The loudspeaker unit provides a compact enclosure defining the folded, expanding horn and housing the acoustic drivers. A scalable number of identical acoustic drivers is provided, each having a relatively small cone or diaphragm, and each being located in a sealed back chamber (e.g. a closed box baffle). The acoustic drivers radiate into volumetrically identical high pressure chambers located in front of the drivers. The acoustic drivers are preferably positioned with respect to one another in a linear array and may vary in number from 2 to 12. Each high pressure front chamber is coupled to a summing throat for the horn by an extended port which operates as a air pressure or air volume velocity step up transformer. The outlets of the ports are acoustically spaced from one another and differentially spaced from the mouth of the horn. Transducer drive circuitry applies drive signals to the acoustic transducers derived from a common source. The signals to the respective acoustic transducers are delayed to reflect the distance of the throats for the respective acoustic transducers from the mouth of the horn. The source signal is also as filtered and phase adjusted as required for clear reproduction of the sound.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
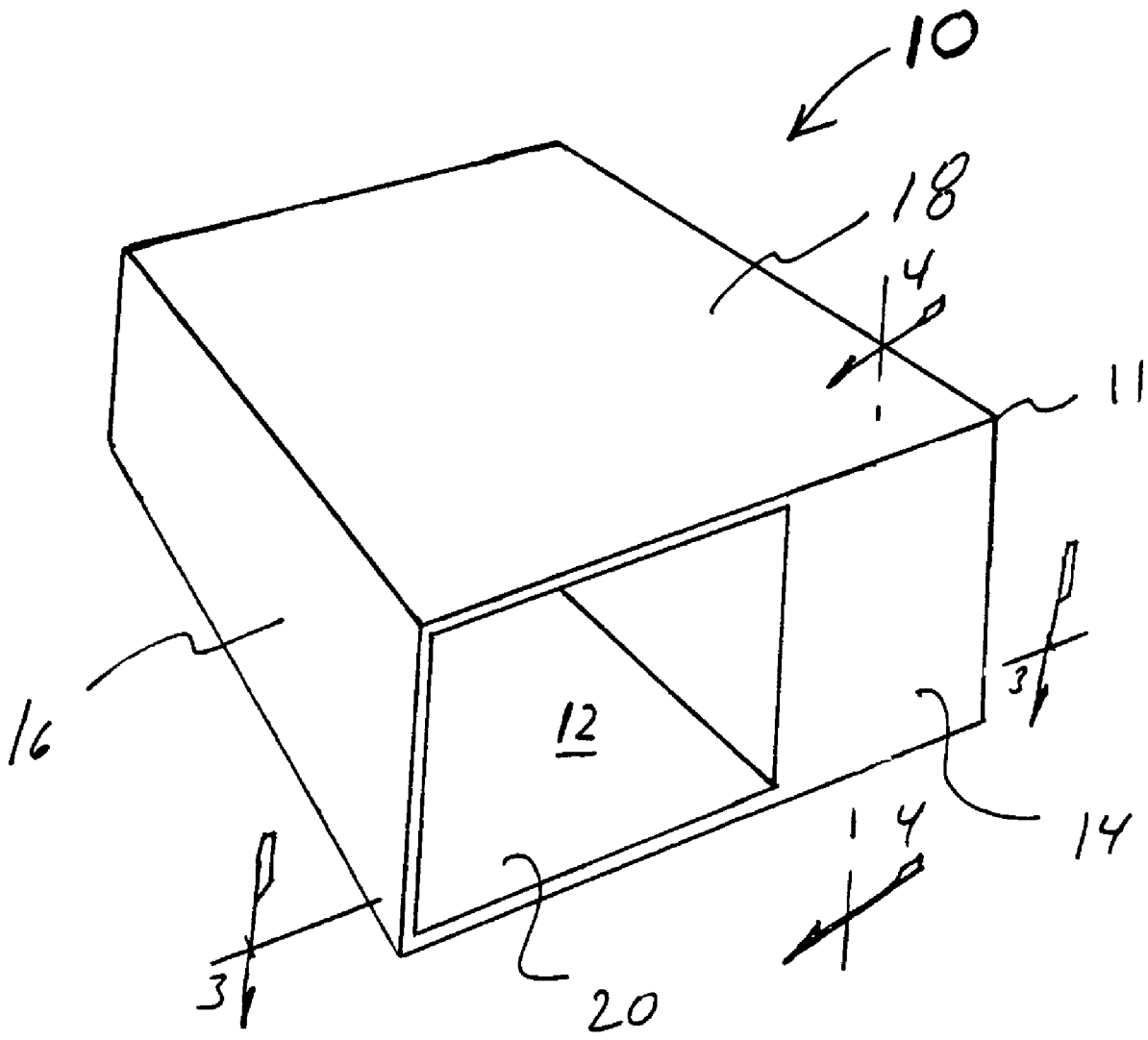
FIG. 1 is a perspective view of a loudspeaker enclosure.

Referring now to the figures and in particular to FIG. 1 there is illustrated a loudspeaker system 10 for use as a high output, transportable unit. Loudspeaker system 10 comprises a right trapezoid enclosure or cabinet 11 which houses sound radiators and a folded waveguide or horn having a mouth 12 in front wall 14. Mouth 12 directs sound radiated from loudspeaker system 10 forward from the unit. Enclosure 11 is constructed from front wall 14, a back wall, a first side wall 16, a second side wall (described below), a cover 18 and a base 20. The bases and walls are conventionally made of plywood or some other material which does not readily absorb sound.

Figure 2:
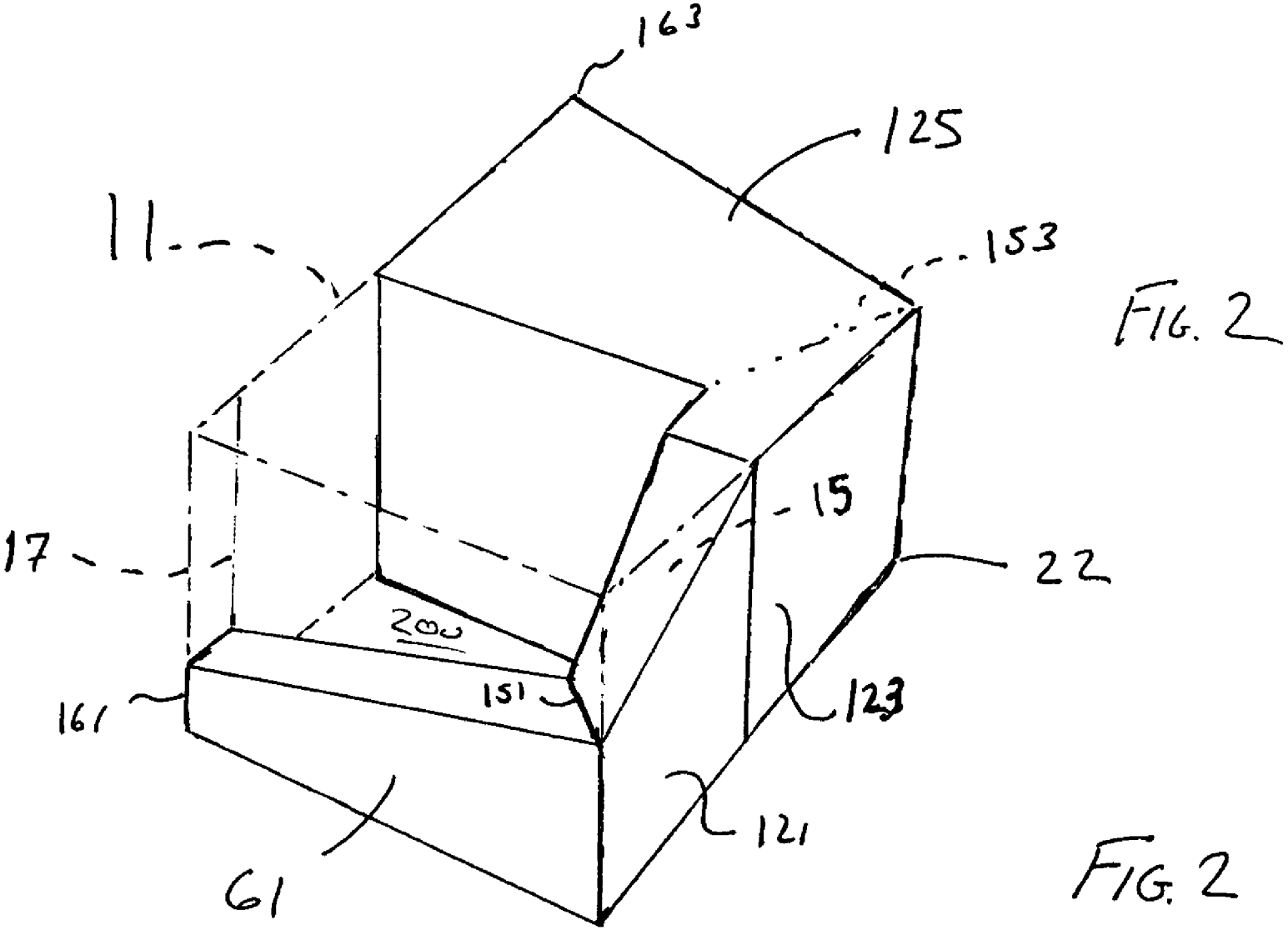
FIG. 2 is a perspective view of the loudspeaker horn.

Referring to FIG. 2, enclosure 11 is presented in phantom at a reverse angle from the view of FIG. 1. Folded horn 22 is optimized for low frequency use and is constructed from flat sides and incorporates a flair, as is conventional. Folded horn 22 is disposed along side walls 16, 17 and the back wall 15 of enclosure 11 which form portions of the horns walls. Folded horn 22 expands cross-sectionally along its entire length from a base end 161, adjacent which the horn has its minimum cross-sectional area, to end 163 where the mouth of the horn is located. Folded horn 22 expands initially both vertically and horizontally, but eventually only in the horizontal dimension. A summing throat 61 is disposed along side 17 which expands in both the vertical and horizontal directions to a fold 151, where it matches with a first backside section 121. Backside section 121 continues to expand in two mutually perpendicular directions up to a second backside section 123. Section 123 is characterized by horn 22 having a constant vertical dimension, however expansion continues in the horizontal dimension at a rate consistent with the horn's flair constant. Vertical expansion is stopped in second backside section 123 not for functional reasons, but for external packaging reasons. Section 123 meets the final horn section 125, which continues to expand in the horizontal dimension, along fold 153. Loudspeakers are nestled in the pocket 200 formed by and partially enclosed by the exterior faces of folder horn 22.

Figure 3:
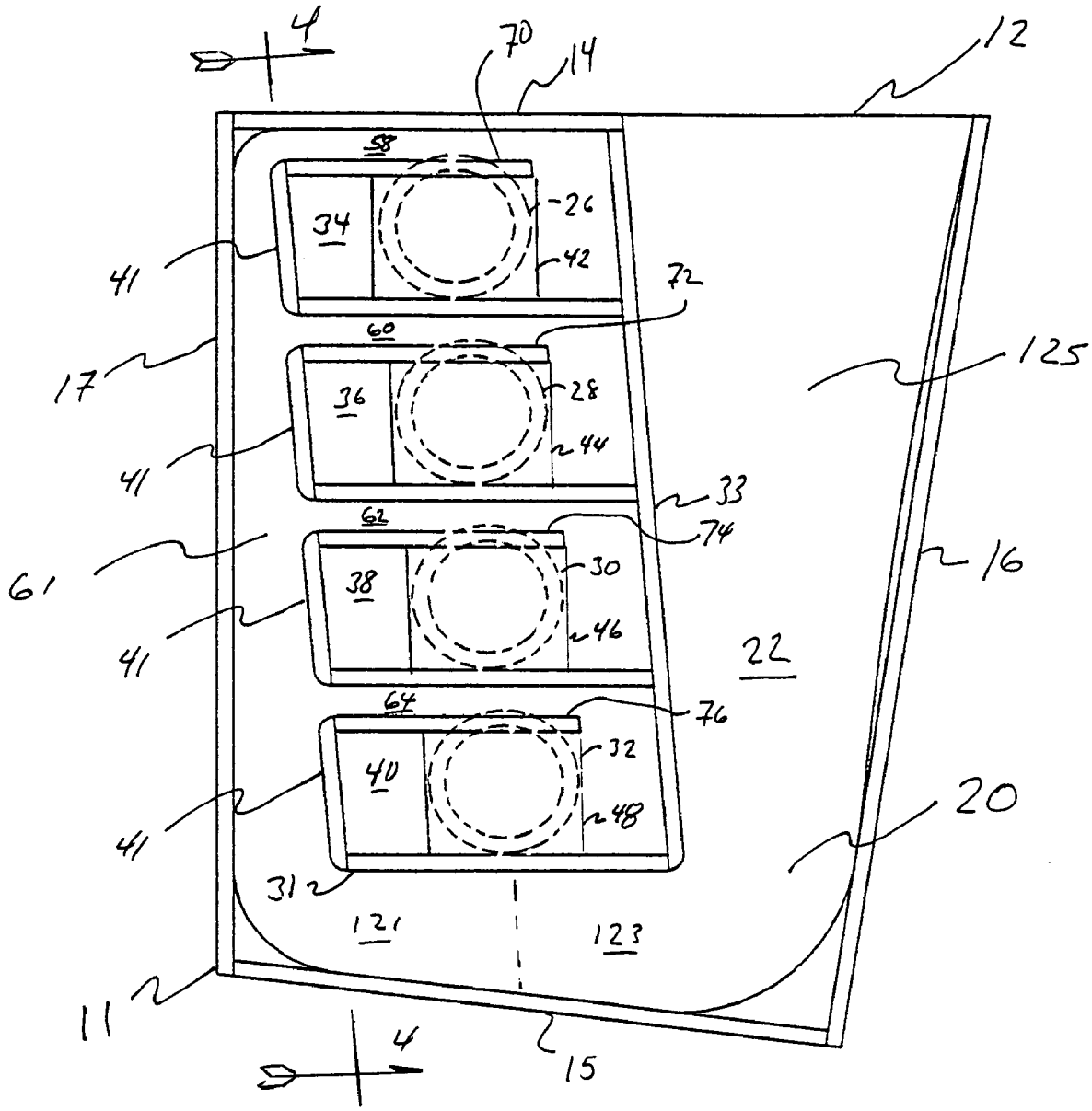
FIG. 3 is a cross sectional view of the loudspeaker enclosure of FIG. 1 taken along section line 3-3.

FIG. 3 is a cross sectional view of enclosure 11 taken along section line 3-3 in FIG. 1. Four walls form the perimeter, exterior sides of enclosure 11 including front wall 14, first side wall 16, back wall 15 and a second side wall 17. The perimeter formed by these walls is broken only by mouth 12 which provides a radiating outlet from the waveguide, i.e. folded, expanding horn 22. Folded horn 22 comprises four major sections and two bends or folds and, as described above, a rectangular cross sectional shape. A horn flare is provided by increasing the area of the section with distance through the horn 22. Initially, the cross-sectional dimensions of folded horn 22 increase in both the vertical and horizontal dimensions, but eventually only in the horizontal. Folded horn 22 includes a summing throat 61 into which four ports or extended throats 58, 60, 62 and 64 are directed. Folded horn 22 expands both vertically and horizontally for the entire length of summing throat 61. Folded horn 22 is divided into two sections 121 and 123 along back wall 15 of enclosure 11. Section 121 continues the two dimensional cross sectional expansion of fold horn 22 from summing throat 61. Section 123 expands only horizontally. Running from section 123 to mouth 12 is the final horn section 125, which also expands only in the horizontal direction.

Four acoustic drivers or transducers 26, 28, 30 and 32 are positioned in enclosure 11 (the latitudinal positions of which are illustrated in phantom) and oriented to direct sound downwardly into four high pressure (or preload) chambers 34, 36, 38 and 40 located directly above base 20. The upper surface of base 20 forms the bottom surfaces of high pressure chambers 34, 36, 38 and 40 which are aligned with one another. Acoustically absorbent pads 42, 44, 46 and 48 are positioned on the upper surface of bottom board 20 within each of chambers 34, 36, 38 and 40 to deaden resonance. Pads 42, 44, 46, 48 correspond to and are vertically aligned with acoustic drivers 26, 28, 30, 32, respectively. High pressure chambers 34, 36, 38 and 40 have acoustic outlet ports formed by extended throats 58, 60, 62 and 64, respectively. Extended throats 58, 60, 62 and 64 direct energy into summing throat 61. The outlets from extended throats 58, 60, 62 and 64 act as diaphragms aligned along one side of the summing throat 61 of folded throat 22. These outlets are at different distances from mouth 12 and, as a consequence, see different output impedances and have different propagation times for the sound energy they emit to mouth 12. The phase and frequency response of horn 22 will differ with respect to extended throats 58, 60, 62 and 64, sometimes in ways difficult to predict in advance for particular horn parameters and thus empirical evaluation may be required to determine the best dynamic phase adjustments, frequency band widths and roll offs to be used with the drive signal for each of the acoustic drivers 26, 28, 30 and 32. High pressure chambers 34, 36, 38, 40 each have the same volume as one another and the throats 58, 60, 62 and 64 have the same cross sectional areas as one another.

Each extended throat 58, 60, 62 and 64 has a cross sectional area which is at least 20% of the area of the diaphragm for the corresponding acoustic drivers 26, 28, 30 and 32. Preferably the diaphragms of drives 26, 28, 30 and 32 are each about 3-½ times the area of the cross section of the extended throats. As the diaphragms move back and forth in alternating fashion to form compression waves in the air mass, the air in high pressure chambers 34, 36, 38 and 40 varies in pressure. The extended throats are relatively constricted in area when constructed the preferred ratio and function as pneumatic amplifiers increasing the volume velocity of the air. Accordingly the movement of driver diaphragms 326, 328, 330, 332 can be made much smaller than is the case on the prior art because changes in air pressure in high pressure chambers 58, 60, 62 and 64 are relatively stiff. At the same time, the high pressure compression chambers 58, 60, 62 and 64 absorb much more power per unit of movement of the diaphragm allowing much larger driver motors 226, 228, 230 and 232 to be employed than in prior art devices. These motors may be two to three times as powerful as is conventional. For maximum power input diaphragms 326, 328, 330 and 332 may be pushed at velocities up to the point of destructive turbulence in the extended throats 58, 60, 62 and 64.

The high pressure chambers, back chambers, extended throat and summing throat 61 are formed in part by vertical interior walls supported from base 20. Vertical interior wall 33 provides a portion of one side of folded horn 22 adjacent mouth 12 opposite the side provided by first exterior side wall 16. Vertical interior wall 33 and side wall 16 diverge from one another toward mouth 12 to provide an expanding cross-sectional area for horn 22. Vertical side wall 33 also provides an interior wall for each of extended throat 58, 60, 62, 64 and for front chambers 34, 36, 38 and 40. The horizontal perimeter of preload or high pressure chamber 34 is completed by vertical walls 25, 41 and 70. The horizontal perimeter of high pressure chamber 36 is completed by vertical walls 27, 41 and 72. The horizontal perimeter of high pressure chamber 38 is completed by vertical walls 29, 41 and 74. The horizontal perimeter of high pressure chamber 40 is completed by vertical walls 31, 41 and 76. Wall 41 is broken in three places by outlets from throat extension guides 61, 62 and 64. The horizontal perimeters of high pressure chambers 34, 36, 38, 40 are broken by throats 50, 52, 54, 56. The horizontal perimeter of throat extension section 58 is completed by vertical walls 14 and 70. The horizontal perimeter of throat extension section 60 is completed by vertical walls 25 and 72. The horizontal perimeter of throat extension section 62 is completed by vertical walls 27 and 74. The horizontal perimeter of throat extension section 64 is completed by vertical walls 29 and 76. Vertical walls 33, 50, 72, 74 and 76 all continue upwardly to provide perimeter elements of substantially sealed back chambers (or closed-box baffles) for acoustic drivers 26, 28, 30 and 32.

Figure 4:
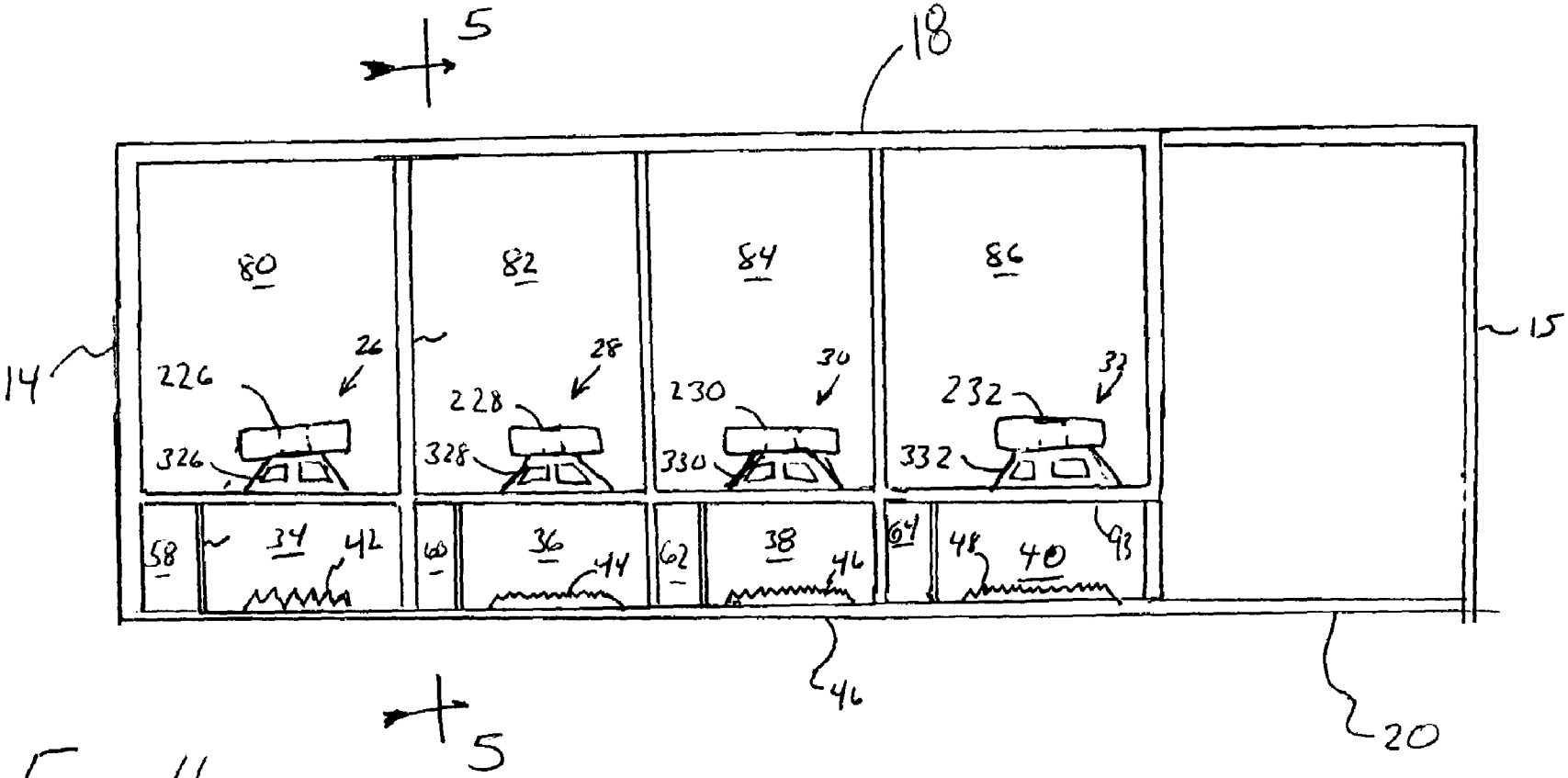
FIG. 4 is a cross sectional view of the loudspeaker enclosure of FIG. 1 taken along section line 4-4.
Figure 5:
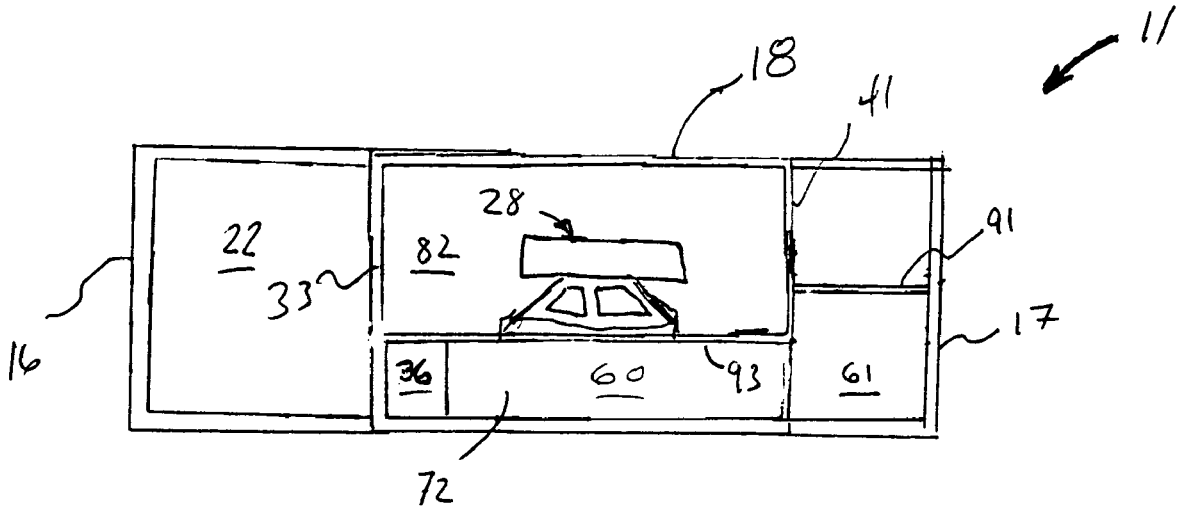
FIG. 5 is a cross section of a transducer housing taken along section line 5-5 in FIG. 3.

Referring to FIG. 4, which is a cross sectional view taken along section line 4-4 in FIGS. 1 and 2 and to FIG. 5, which is view taken into enclosure 11 along section line 5-5 in FIG. 4, the positioning of acoustic drivers 26, 28, 30, 32 over high pressure chambers 34, 36, 38 and 40 is illustrated. Acoustic drivers 26, 28, 30, 32 are housed in sealed back chambers 80, 82, 84 and 86, respectively. The term "sealed" as used here has its conventional meaning in the acoustical arts to mean that the back chambers have no acoustic outlet port. The only acoustic opening from sealed back chambers 80, 82, 84 and 86 are those directly in front of the diaphragms of acoustic drivers 26, 28, 30 and 32. Back chambers 80, 82, 84 and 86 do slowly exchange air with their ambient environment, as is conventional.

Figure 6:
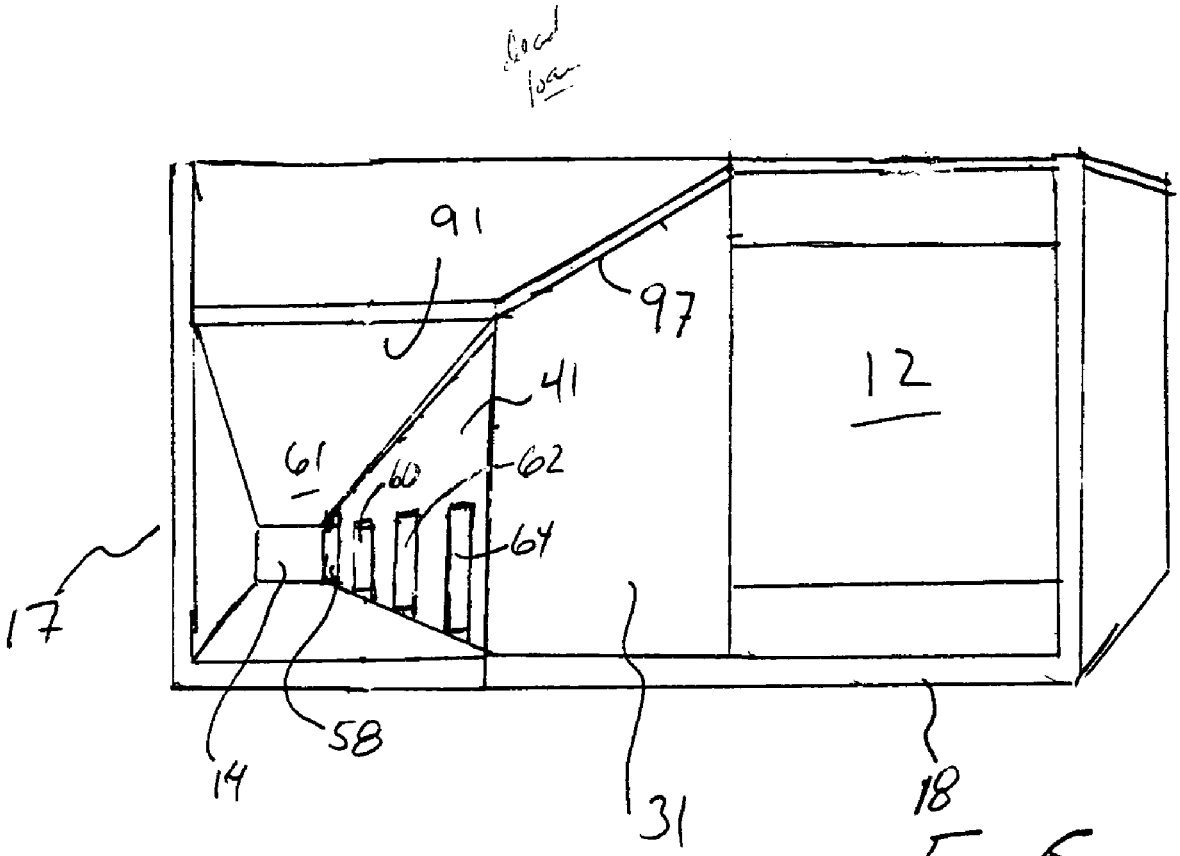
FIG. 6 is a rear elevation of the enclosure of FIG. 1 with the back panel of the enclosure removed.

In FIG. 5 the position of extended 60 in front of wall 72 illustrates the interface of a representative high pressure chamber 36 to its extended throat 60 and further into summing throat 61. Because the upper cover section 91 is not horizontal, but slants upwardly from the base of summing throat 61 toward the back wall 15, the outlet from extended throats into summing throat 61 differs for each extended throat. Extended throat 60 includes some freeboard on wall 41 above the outlet and below upper cover section 91. As illustrated in FIG. 6 and described with reference to the figure below, the amount of freeboard for each port will differ.

Acoustic driver 28 rests on a support plane 93. Sealed back chamber 82, like the remaining back chambers, is closed on one side by a planer wall 95.

Referring now to FIG. 6, which is an end view of enclosure 11 with back wall 15 removed, the interior of folded horn 22 is illustrated in greater detail, particularly the summing throat 61. Summing throat 61 is formed by portions of side wall 17, cover 91, base 18 and wall 41. Summing throat 61 collects sound output from the four throat extension sections 58, 60, 62, 64, the radiating outlets of which are visible along a side of summing section 61 defined by vertical wall 41. The surfaces forming summing throat 61 diverge from one another moving toward the back wall 15 from the base of the horn along front wall 14. The divergence of the upper and lower surfaces of folded horn 22 is provided in the upward slant of board 97. While the output port from extended throat 58 has a vertical extent substantially equal to the local height of summing throat 61, the outlets of downstream extended throats 60, 62 and 64, which are all of the same height, will have increasing amounts of freeboard.

Any given horn has differing horizontal and polar frequency responses. And while a horn may operate well at certain frequencies its performance can degrade markedly at other frequencies. These changes in performance are highly dependent on the length of the horn. While each of transducers 26, 28, 30, 32 is coupled to the folded horn by an identical high pressure chamber and extended throat, the extended throats in 56, 60, 62 and 64 are coupled to summing junction 61 at points which are differently spaced from the mouth 12. In other words, horn 22 will have different performance characteristics for each transducer including, different optimal frequency operating range. Accordingly, each driver circuit differentially treats the signal applied to each transducer.

Producing sound of maximum intensity from loudspeaker system 10 requires that acoustic pressure waves from the outlets of extended throats be synchronized at the points where they merge. Due to the different distances sound travels to reach mouth 12 from the outlets from extended throats 58, 60, 62 and 64, the drive signal applied to transducers 26, 28, 30, 32 is time differentiated so that the sound waves constructively reinforce one another in summing section 61 rather than cancel or interfere with one another. While the same signal is the genesis of the signal used to drive each of the four transducers 26, 28, 30, 32, this source signal must be processed differently before application to the respective transducers' voice coils to assure good phase matching at the mouth 12 and a good match of output from the extended throats 58, 60, 62 and 64 to the frequency response characteristic of folded horn 22 for a given outlet port from one of extended throats 58, 60, 62 and 64. The signal for the transducer associated with the throat radiating end removed by the greatest distance from mouth 12 is delayed least, while the signal driving the transducer associated with the throat radiating end closest to mouth 12 is delayed by the greatest period. Differences in impedance matching of the extended throat for each driver to summing section 61 require some band pass filtering and shading of the source signal for optimal system performance. The source signal may require dynamic phrase adjustment (i.e. adjustment of the signal phase as a function of frequency) of the source signal due to the frequency response characteristics of the horn which vary with frequency at each extended throat outlet port.

Figure 7:
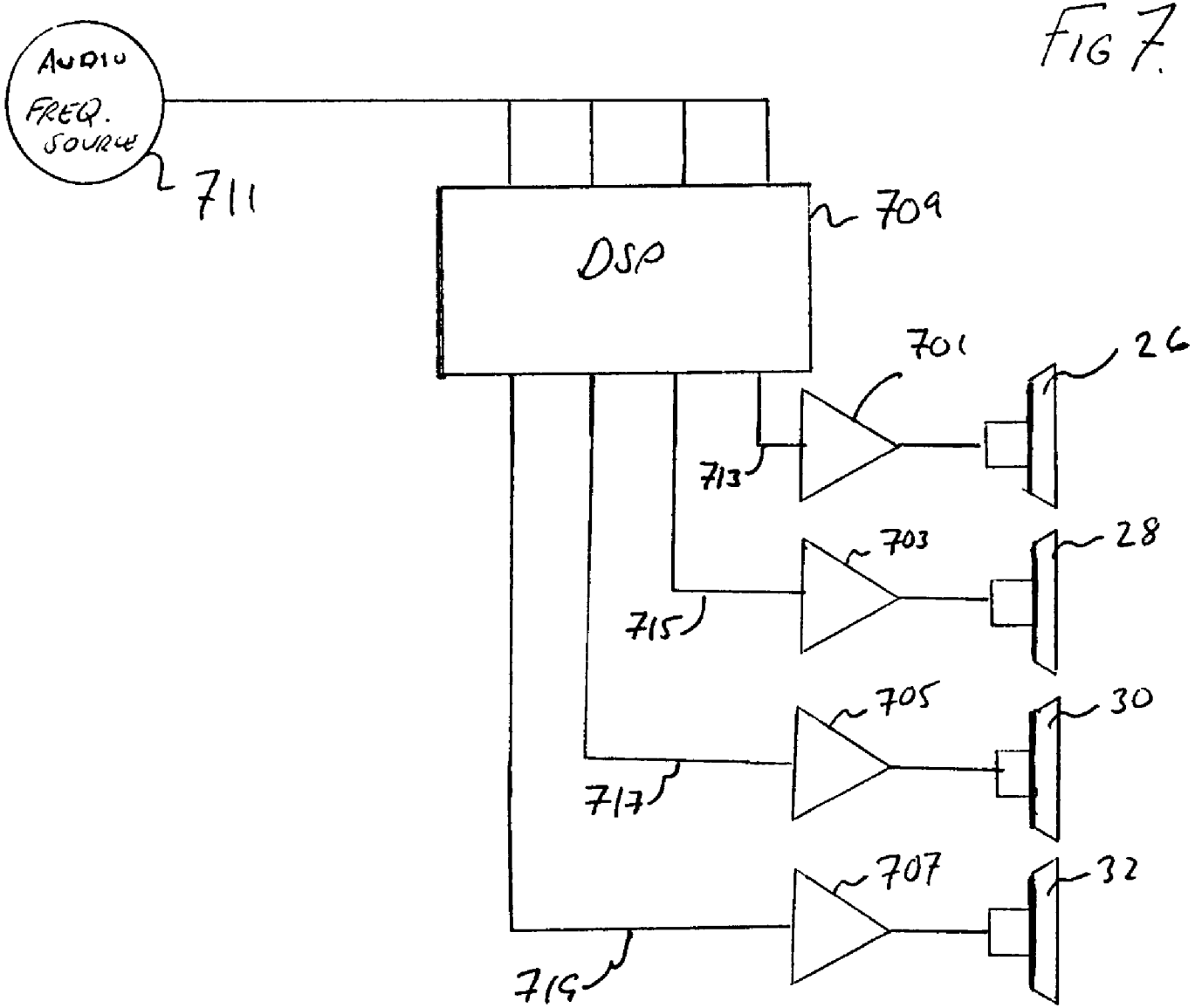
FIG. 7 is a block diagram schematic of drive circuitry for the loudspeaker.
Figure 8:
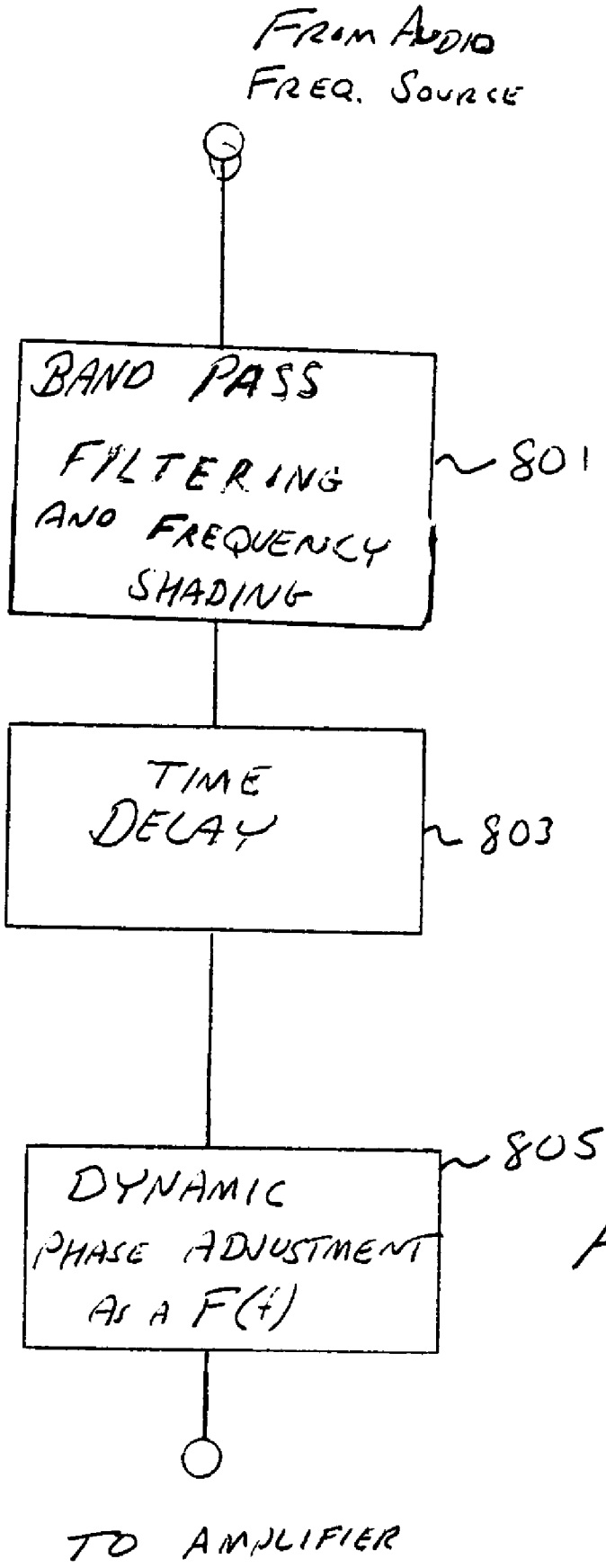
FIG. 8 is a block diagram schematic of the operation of the circuitry of FIG. 7.

Referring to FIGS. 7 and 8, a common source 711 of audio frequency signals is applied to four inputs of a digital signal processor (DSP) 709 which differentially processes the signals to accommodate the relative positions of acoustical drivers 26, 28, 30, 32. DSP 709 provides the four differentiated outputs on each of four channels 713, 715, 717, 719 to four amplifiers 701, 703, 705 and 707 associated with acoustical drivers 26, 28, 30, 32. In general, the input signal is processed in the same general way for all four channels, with only the parameters applied by the processing steps changing. For each channel, the signal is fed through a band pass filter 801 which passes frequency ranges best handled by a particular horn/driver configuration. Typically, the broadest band of frequencies is applied to the acoustic driver couple to the summing junction 61 at the furthest point from mouth 12. The roll off of the signal range applied to a driver may also be adjusted. Next, the filtered signal is applied to a time delay 803 which synchronizes the signals based on the differing distances of the speakers from the horn mouth. Lastly, the filtered, delayed signal for a channel is applied to a dynamic phase adjustment module 805, which adjusts the phase of the signal as a function of frequency. The specific parameters used will change along with changes in horn dimensions and the number of transducers used.

Figure 9:
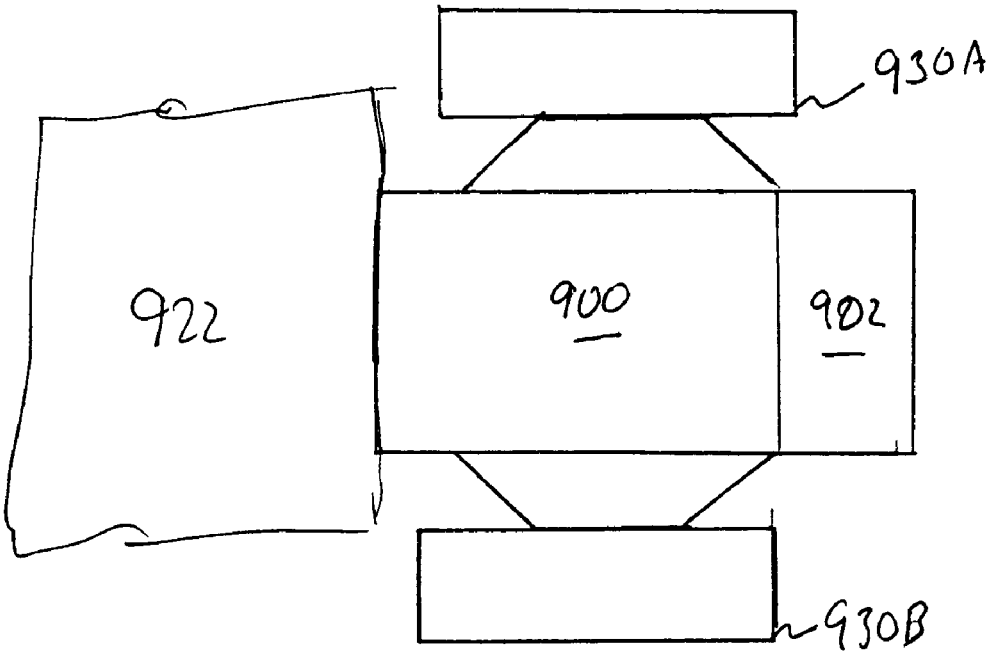
FIG. 9 is a side elevation of a high pressure chamber exited by paired drivers.

FIG. 9 illustrates an alternative embodiment of the invention whereas two acoustic drivers 930A and 930B are coupled to a common high pressure chamber 900. Sound is coupled from compression chamber 900 to a horn 922 by an extended throat 902 which has a cross sectional area which is a fraction of the area of the diaphragms of acoustic drivers 930A-B. Extended throat 902 operates as a kind of pneumatic amplifier greatly accelerating air velocity. Still other arrangements of transducers and horn types will now occur to those skilled in the art.

The invention provides high acoustic output power for low frequency sound from a minimally sized, portable cabinet, suitable for use at outdoor, temporary venues. The package is well suited for bass line reproduction required for rock music reproduction.

While the invention is shown in only one of its forms, it is not thus limited but is susceptible to various changes and modifications without departing from the spirit and scope of the invention.

What is claimed is:

1. A loudspeaker comprising:

an enclosure including a folded horn having a base end and a mouth;

a summing throat forming a portion of the folded horn including the base end, the summing throat increasing in cross sectional area in a direction of acoustic energy propagation;

a plurality of acoustic transducers housed in the enclosure;

a plurality of radiating ports, each radiating port providing for coupling sound energy from each respective acoustic transducer into the summing throat, each radiating port being disposed at a discrete, acoustically spaced location along the summing throat with successive locations of the radiating ports occurring at points along the summing throat exhibiting increasing cross sectional area to initiate and synchronously reinforce an acoustic pressure wave building from the base end toward the mouth;

a source of an acoustic range signal;

transducer drive signal processing circuitry having an individual channel for each of the audio transducers, the individual channels each being coupled to receive the acoustic range signal and each channel including means for setting a relative phase angle for the acoustic range signal in a channel as a function of the acoustic spacing of the radiating outlets to build an acoustic pressure wave in a cascade in the summing throat toward the mouth;

a plurality of high pressure chambers, at least one acoustic transducer being positioned to direct sound energy into each high pressure chamber, and each high pressure chamber being connected by one of the plurality of radiating ports to the summing throat; and each radiating port terminating along a side of the summing throat at successive locations progressing from the base end of the summing throat toward the mouth of the folded horn with a direction of sound propagation transverse to the direction of sound propagation in the summing throat.

2. A loudspeaker as set forth in claim 1, each channel of the transducer drive signal processing circuitry further comprising:

a band pass filter receiving the acoustic range signal and producing a filtered signal therefrom;

the time delay element receiving filtered signal and producing a delayed, filtered signal; and a dynamic phase adjustment element receiving the delayed, filtered signal and adjusting the phase of the signal as a function of frequency to produce a drive signal for an acoustic transducer.

3. A loudspeaker as set forth in claim 2, wherein the band pass filters, delay elements and dynamic phase adjustment elements are realized in a digital signal processor.

4. A loudspeaker as set forth in claim 2, further comprising:

the acoustic transducers having a small vibrational surface area relative to the predominant range of frequencies to be reproduced; and a plurality of sealed back chambers, one sealed back chamber housing each acoustic transducer.

5. A loudspeaker as set forth in claim 4, further comprising:

the audio transducers being positioned with respect to one another in a linear array, one to each high pressure chamber.

6. A loudspeaker as set forth in claim 4, further comprising:

a plurality of acoustic transducers coupled to each high pressure chamber.

7. A loudspeaker unit comprising:

a plurality of low frequency acoustic transducers;

a plurality of pre-load chambers, at least one pre-load chamber being associated with each of the plurality of low frequency acoustic transducers;

each low frequency acoustic transducer being disposed to radiate into its associated pre-load chamber;

a horn having a base end and a mouth and formed at least in part by a surface extending from the base end to the mouth; and a plurality of ports connecting the plurality of pre-load chambers into the horn, each of the plurality of ports having a radiating opening on the surface of the horn, the radiating openings being disposed along the surface extending in line from adjacent the base end toward the mouth substantially parallel to the direction of sound propagation in the horn to support cascade formation of pressure waves from the base end toward the mouth, and with the radiating openings being oriented to direct sound into the horn locally substantially transverse with respect to an axis of sound propagation defined by the horn.

8. The loudspeaker unit in accord with claim 7, further comprising:

a right trapezoid enclosure for the horn, which is folded within the right trapezoid enclosure.

9. The loudspeaker unit in accord with claim 7, further comprising:

means for coordinating operation of the low frequency acoustic transducers so that the pressure waves from the radiating ends emitting from the radiating openings reinforce one another.

10. The loud speaker unit in accord with claim 9, wherein the acoustic transducers are housed to emit from sealed back chambers.

11. The loudspeaker unit in accord with claim 9, the means for coordinating further comprising drive circuitry for the low frequency acoustic transducers including delay means for synchronizing merger of the pressure waves upon their meeting in the horn.

12. The loudspeaker unit in accord with claim 11, the drive circuitry including a pass band filter and a dynamic phase adjustment element for each of the low frequency acoustic transducers.

* * * * *